US007077720B2

(12) United States Patent
Schneider et al.

(10) Patent No.: US 7,077,720 B2
(45) Date of Patent: Jul. 18, 2006

(54) MATERNITY AND/OR NURSING BREAST SUPPORT FOR FASHIONABLE WOMEN'S APPAREL

(75) Inventors: Loretta Lynn Schneider, Kinnelon, NJ (US); Roslyn Harte, New York, NY (US)

(73) Assignee: Nurture Bra LLC, Kinnelon, NJ (US)

( * ) Notice: Subject to any disclaimer, the term of this patent is extended or adjusted under 35 U.S.C. 154(b) by 0 days.

(21) Appl. No.: 10/924,348

(22) Filed: Aug. 23, 2004

(65) Prior Publication Data

US 2005/0026540 A1 Feb. 3, 2005

Related U.S. Application Data

(63) Continuation-in-part of application No. 10/386,762, filed on Mar. 12, 2003, now Pat. No. 6,839,908.

(60) Provisional application No. 60/448,973, filed on Feb. 20, 2003.

(51) Int. Cl.
*A41C 3/00* (2006.01)

(52) U.S. Cl. ..... 450/36; 2/104

(58) Field of Classification Search ..... 450/36–38, 450/7–11, 30–35; 2/73, 104–106, 78.1–78.4, 2/70, 113–115, 67, 69
See application file for complete search history.

(56) References Cited

U.S. PATENT DOCUMENTS 2,928,396 A * 3/1960 O'Dell ..... 450/30
3,176,692 A * 4/1965 Marino ..... 450/30
3,746,007 A * 7/1973 Hand et al. ..... 450/31
4,004,294 A * 1/1977 Pinch ..... 2/104
4,144,593 A * 3/1979 Timmons ..... 2/104
4,208,743 A * 6/1980 Whitcraft ..... 2/104
4,390,024 A * 6/1983 Williams ..... 450/36
4,528,699 A * 7/1985 Hughes ..... 2/104
4,648,404 A * 3/1987 Clark ..... 450/31
4,660,227 A * 4/1987 Abramson ..... 2/104
4,878,879 A * 11/1989 Kunstadter ..... 450/36
5,461,725 A * 10/1995 Witczak ..... 2/104
6,282,719 B1 * 9/2001 Vera et al. ..... 2/78.1

* cited by examiner

*Primary Examiner*—Gloria M. Hale
(74) *Attorney, Agent, or Firm*—Rashida A. Karmali

(57) ABSTRACT

This invention provides women's apparel including camisoles, tankinis or dresses, each having a unique and improved maternity and/or nursing breast support and enables the wearer to comfortably unsecure and secure a flap on a bra cup upon completion of nursing. The main inventive feature is a dynamic non-continuous or hanging bra support system made with a plurality of fabric members triangular in shape to allow a sizeable opening in each brassiere cup. The fabric members in each cup are joined at the upper end and create vertically oriented openings for maximum breast exposure that allow access to the breast and at the same time leave room for expansion of the breasts. The upper edges of the triangular cups are diagonally oriented, and the cups are attached only partially, at the lower portion to narrow regions of a stretchable band and/or laterally, to the side, thus providing flexibility, support and comfort for the wearer.

15 Claims, 6 Drawing Sheets

MATERNITY AND/OR NURSING BREAST SUPPORT FOR FASHIONABLE WOMEN'S APPAREL

CROSS REFERENCE TO OTHER APPLICATIONS

This is a continuation-in-part of U.S. application Ser. No. 10/386,762 filed on Mar. 12, 2003 now U.S. Pat. No. 6,839,908, , which is a continuation-in-part of Provisional Application (Ser. No. 60/448,973) entitled "Maternity and/or Nursing Breast Support for Fashionable Women's Apparel", filed Feb. 20, 2003 now abandoned, both being incorporated by reference herein in their entirety.

FIELD OF THE PRESENT INVENTION

This invention relates to women's apparel in general, and garments designed for pregnant and/or nursing mothers. More particularly, the invention comprises a maternity and/or nursing breast support that may be incorporated in women's garments to facilitate the process of breast-feeding, while providing the mother with maximum comfort and support for her breasts. The embodiments of the present invention and related women's apparel serve two functions, to make the breasts easily accessible with minimum undressing, and provide support without having to resort to use of thick elastic materials or under wire. Countless designs exist, each with its respective strengths and weaknesses. The present invention fulfills the needs of nursing and/or pregnant mothers who are in need of an undergarment that provides the extra needed support for their enlarging breasts without subjecting them to unnecessary discomfort and even skin irritations or infections, or being limited to wear unimaginative and/or unfashionable women's apparel.

BACKGROUND OF INVENTION

The need for women's apparel suitable to make breast feeding possible without detracting from styling or aesthetic considerations has been recognized, and addressed by several issued United States patents, for example, U.S. Pat. Nos. 4,004,294; 4,648,404; 4,208,743; 4,660,227; 5,544,364; 5,461,725; 6,282,719 B1; 4,528,699; U.S. Patent and U.S. Publication No. 2001/0039672 A1.

Previous relevant and prior art has been directed towards underwear, sleepwear, dresses, blouses, lingerie and other underwear for the purpose of allowing mothers to breast feed without disrobing. Each of these garments requires the use of an incorporated or external nursing brassiere. These brassieres provide support in a similar fashion to that used by traditional brassieres. An inherent flaw in their design is that they cannot expand freely to allow for the swelling of the breast that occurs between feedings, and the nursing mother has to obtain larger sizes to ensure comfort. Elastic materials and wires used to provide support to the breasts allow some level of stretch but usually not enough, and as a result are uncomfortable, and along with sweating may cause skin irritation and itching in areas of contact. Mastitis may occur as a result of the constriction caused by current nursing bras. U.S. Pat. No. 5,697,830, issued to B. E. White teaches a nursing brassiere with a shortened support wire that provides breast support under normal wear conditions. The brassiere has overlapping frontal portions each with a cuplike configuration for covering the wearer's breasts, and the lower portions of frontal portions are attached in their entirety, to a lower elastic sewn portion below the breast, which includes a wrap-around band. When nursing takes place, a frontal portion is pulled aside to displace the supporting wire and expose the breast for nursing access. However, this embodiment does not allow for comfort when the breasts swell with milk and cause stretching of the elastic wrap-around band and the under wire.

U.S. Pat. No. 6,282,719B1 issued to C. A. Vera and L. D. tucker, describes a combination nightgown and bra for women after pregnancy; the bra enables the wearer to nurse her baby by unsecuring a flap on either cup and resecuring upon completion of nursing without the need for taking off any articles of clothing. The invention includes two triangular bra cups having an upper edge and a bottom edge; each of the upper edges is attached to a shoulder strap by a hook and loop fastener, and each of the bottom edges is attached in its entirety to an elastic band skirting all around to provide support. This invention does not provide for support and comfort of swelling breasts because both bra cups are fully attached at the bottom edge to the elastic band, and in the middle portion to each other. The elastic band is constrictive and may be uncomfortable when the breasts are enlarged. As discussed above, this along with sweating may cause skin irritation.

U.S. Publication No. U.S. 2001/0039672 A1 filed by J. B. Force describes a nursing brassiere constructed as a garment in which the support is provided with cups which fit snugly to hold breast pads. The breast cup has 1) a bottom frontal panel that is attached to a top panel constructed of stretchable fabric and 2) a bottom frontal panel joined to a one and one half inches wide elastic band going around the diaphragm giving adequate support. Thus the flaw in this garment is the use of the stretchable fabric and elastic band all around to provide support to the variably expanding breasts.

U.S. Pat. No. 4,648,404 issued to S. A. Clark describes a functionally coordinated nursing slip and a subjacent coordinated nursing bra which can be worn together or separately when desired. The slip bosom and the bra-nursing flap open and close decorously and efficiently as a unit since they are surface connected. This surface connection also supports the slip when its shoulder straps are connected to open the unitary bosom, that is, the opened slip shoulder straps are retained on the bra so that they do not become lost during nursing under the wearer's clothing.

Thus, countless designs have been described, each with its prospective strengths and weaknesses. Despite the myriad of choices available, there are still needs that are not met by the presently available options. In fact, the present invention was conceived by the co-inventor, L. L. Schneider III, when she herself was nursing her baby and could not find a suitable breast support that could be adapted for use in her maternity and/or nursing and later, regular garments.

SUMMARY OF THE PRESENT INVENTION

The present invention provides a solution to the disadvantages mentioned above in the prior art, in that it provides support and access to the breasts without requiring additional support from elastic or other stretchable bands. The maternity and/or nursing breast support of the present invention allows the opening and closing of a breast cup to access breast milk for the baby by separating the top front panel from the shoulder strap by using one hand to open a fastening means and lower a flap of the upper member of the garment. The garment nursing flaps open and close decorously and efficiently separately since they are not surface connected to the shoulder strap of the maternity and/or nursing breast support. When the flap is opened for a unitary bosom, the opened slip or garment shoulder strap is retained on the maternity and/or nursing breast support so that the flap does not become lost during nursing under the wearer's clothing and does not disturb the baby.

In a variety of different embodiments, the maternity and/or nursing breast support of the present invention may be incorporated into a slip, a night gown, a sun dress, a tank top, a camisole, a swimsuit, a blouse, a shirt, a sweater, a sport shirt, lounge wear, sleepwear, tee shirt, brassiere or a dress, with short, three quarters length, long sleeves, cap sleeves or any style sleeves.

It is the primary object of the present invention to provide a maternity and/or nursing breast support that may be worn as part of a garment without the need for a conventional brassiere for easy access to the breast.

It is another object of the invention to provide a maternity and/or nursing breast support that offers support and is aesthetically pleasing. The maternity and/or nursing breast support does not require dexterous manipulation while the breast cup flaps are being opened or closed. The maternity and/or nursing breast support allow expansion and contraction of the nursing women's breasts comfortably. The ability to expand and contract is derived from the structural design of a dynamic support means, and the stretchable yet flexible fabric used.

It is yet another object of the invention to incorporate the maternity and/or nursing breast support into regular women's apparel that may be worn by women who are not pregnant or nursing, in this case, the garment flaps are stitched into the shoulder strap panel.

In a preferred embodiment of the invention, the maternity and/or nursing breast support is incorporated into a slip having a bodice and skirt.

In another preferred embodiment of the invention, the maternity and/or nursing breast support is incorporated into a slip, which is in one piece.

In yet another preferred embodiment of the invention, the maternity and/or nursing breast support is incorporated into a dress with any style of sleeves.

BRIEF DESCRIPTION OF THE FIGURES AND PREFERRED EMBODIMENTS

The advantages and features of the present invention will become readily apparent after reading the following detailed description and referencing the drawings. In order to facilitate a fuller understanding of the present invention, reference is made of the drawings, which should not be construed as limiting the present invention, but are intended to be exemplary only and, which are:

DETAILED DESCRIPTION OF THE PREFERRED EMBODIMENTS

Figure 1:
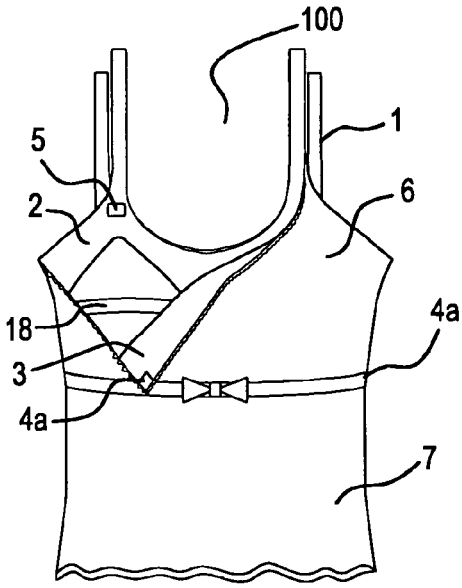
FIG. 1 is a frontal view of the garment piece in the shape of a camisole having a bodice portion, the garment piece has attached to it a maternity and/or nursing breast support and a bra cup open.

This invention provides women's apparel having a unique and improved maternity and/or nursing breast support. The variously designed women's garments may be used by pregnant, nursing or any woman, because the maternity and/or nursing breast support provides proper support and enables the wearer to comfortably and conveniently unsecure a flap on either side of the bra cup to have access to the breast, and resecure the flap upon completion of nursing. The garments may be designed for wear for all occasions by a pregnant or nursing mother, and may be adapted to be worn by any individual wearer.

The main inventive feature is that the maternity and/or nursing breast support is constructed as a "dynamic support system." The phrase, "dynamic support system," used herein means that the maternity and/or nursing breast support is not attached in its entirely along its borders to the main garment, or at the middle to join the two cups. That is, the maternity and/or nursing breast support is constructed of a plurality of fabric members in a triangular shape to allow a sizeable opening in each brassiere cup. Since the upper ends of the fabric members are joined in each cup they create vertically oriented openings that allow access to the breast and at the same time leave room for expansion of the breasts. The left and right bra cups are not attached rigidly from the top to the bottom, to each other, but instead, the upper edges of the cups are diagonally oriented to form a sweetheart neckline or a deep neckline, and join for a short length only at the center, to form a narrow joined portion. Each cup may be attached only partially, at its lower portion by the narrow joined portion to only very narrow regions of a stretchable and flexible band in the waist region, and/or to the side by side seams to the garment, thus providing flexibility, support and all the while, ensuring comfort for the wearer. The flexible and stretchable band support is made of stretch fabric to give the lactating mother additional support and comfort for her expanding and contracting breasts. The stretchable band may be made of the same fabric as the garment or of a different material.

The maternity and/or nursing breast support is attached underneath the surface garment at various locations, including the shoulder strap of the garment, at the lower portion of the bra cups to a stretchable and flexible band and in the side portions of the bra cups to the side of the garment. This support provides support to the breasts and dose not require use of an under wire with all its disadvantages of discomfort, sweating or mastitis in lactating women, as in the case in bra supports available currently. Two flaps extend from the garment apex on the left and right side, and are attached to the left and right shoulder straps respectively, to shield the maternity and/or nursing breast support and the breasts from view. These flaps extent over the structure of the maternity/nursing support to prevent inadvertent sighting of the support, and the flaps are attached by a fastening means including, but not limited to snap closure, buttons, hooks, loops, hook and loop, hook and eye, VELCRO hook and loop fastener strips, ribbon ties or adhesive tape fasteners.

The following detailed description of the preferred embodiments can be better understood if reference is made to the attached drawings for FIG. 1 to FIG. 12, in which:

FIGS. 1 through 5 show one embodiment of the maternity and/or nursing breast support incorporated in women's apparel, a garment (100) in the shape of a camisole having a bodice portion and a skirt. This garment is also suitable for use as nightwear, house gown, sundress or regular everyday wear. Garment (100) accomplishes the purposes stated above by using the maternity and/or nursing breast support member having a dynamic support system with each bra cup having a plurality of fabric members that vertically oriented opening for access. Referring to FIG. 1, garment (100) includes an upper member (6) and a lower member (7). Upper member (6) further comprises a left and right shoulder strap (1). The shoulder straps may be made with fabric that is stretchable or elastic, extending from above the bodice to the back of the bodice in various lengths depending on the height and bust size of the wearer.

Figure 3:
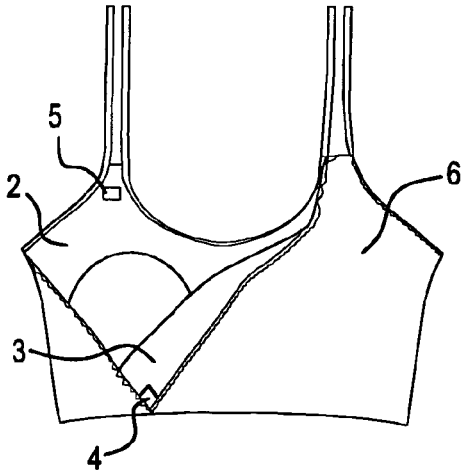
FIG. 3 is a frontal view of the maternity and/or nursing breast support or brassiere, with one side of the garment flap lowered.
Figure 4:
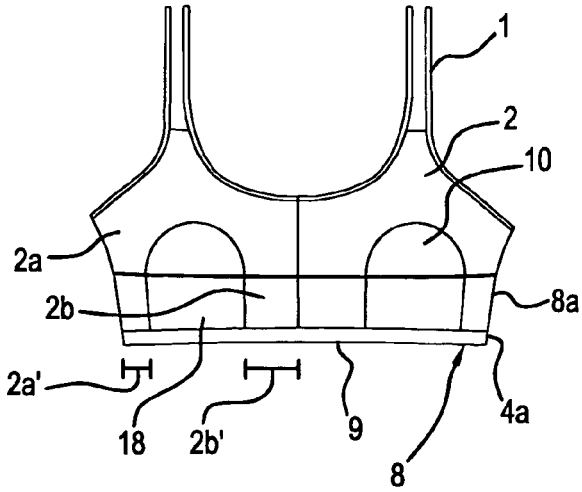
FIG. 4 shows a frontal perspective of the maternity and/or nursing breast support or brassiere of the present invention.
Figure 5:
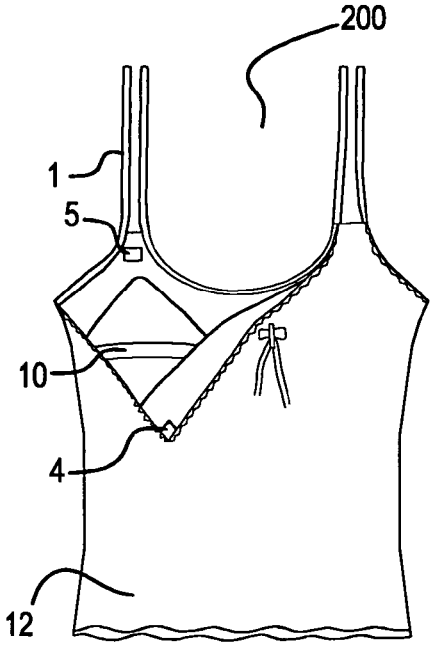
FIG. 5 is a frontal view of the garment piece in the shape of a camisole in the shape of one piece, that is, having no separate portions for bodice above the bra line and bodice, the garment piece has attached to it a maternity and/or nursing breast support and a garment flap open.
Figure 6:
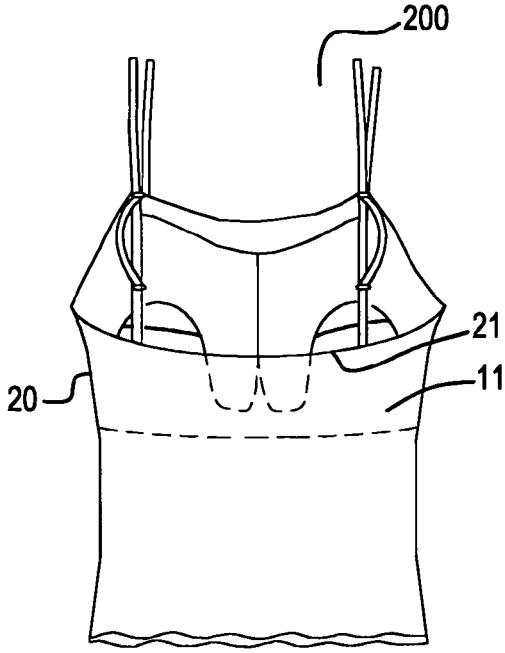
FIG. 6 is a back view of the garment piece of FIG. 5, in the shape of a camisole.
Figure 7:
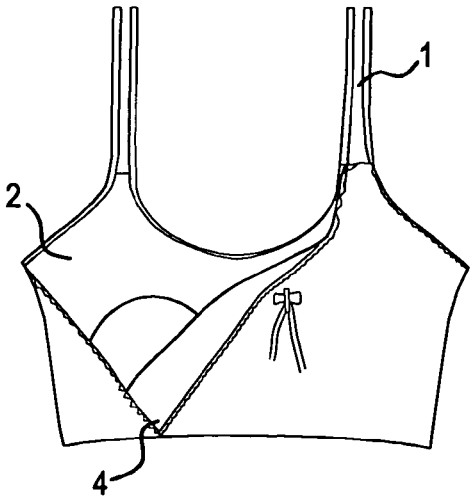
FIG. 7 is a frontal view of the maternity and/or nursing breast support of brassiere, with one side of the garment flap lowered.
Figure 8:
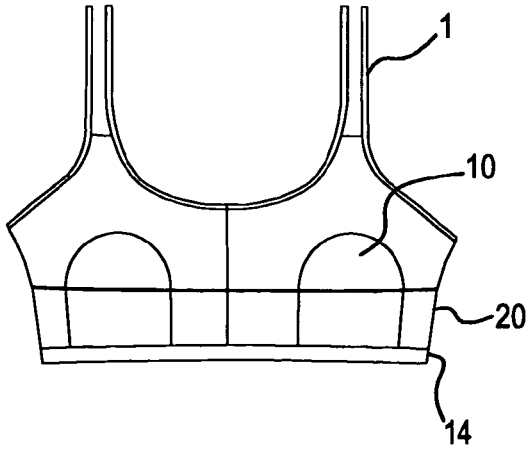
FIG. 8 shows a perspective of the maternity and/or nursing breast support of brassiere of the present invention.

Referring to FIGS. 1, 3 and 4, representing the front view, each shoulder strap (1) has affixed to it a member of the fastening means (5). The corresponding pair member of the fastening means (4) is affixed to the apex of the garment flap (3). The type of members of fastening means (4) and (5) used may be selected from the group consisting of snap closure, buttons, hooks, loops, hook and loop, hook and eye, VELCRO hook and loop fastener strips, ribbon ties and adhesive tape fasteners.

The maternity and/or nursing support breast support, shown in FIG. 4, comprises the shoulder portion (2) that is stitched to the shoulder strap (1) of the garment (100), in the location of the member of fastening means (5). The maternity and/or nursing breast support member further includes a plurality of fabric members (2*a*) and (2*b*) that together appear to be triangular shaped bra cup portions. The fabric members (2*a*) and (2*b*) form a triangular shaped brassiere cup and are joined at the upper end to form a shoulder portion (2) near the apex of the garment flap (3). Each flap has a member of the fastening means (4).

Each of the shoulder portions (2) is attached to the upper member (6) of the garment. Each of the fabric members (2*b*) has an upper edge, which is diagonally situated to form a contoured neckline (15). Each of the triangular shaped brassiere cups further includes a sizeable opening (10) for maximum breast exposure, the opening which extends to the lower portion of the triangular shaped cup to allow access to the breasts and to allow room for comfortable expansion of each breast. The unique feature of the present invention is the opening (10) bordered on one side by the lower half of fabric member (2*a*), and on the other side by the lower half of fabric member (2*b*). The portion in between (2*a*') and (2*b*") is left open and not attached to the stretchable band (4*a*), to allow room for the breasts, prevent constriction, discomfort and skin irritation.

The lower ends of fabric members 2*a* and 2*b* are attached to a stretchable band (4*a*), at narrow portions represented by 2*a*' and 2*b*' (FIG. 4). The stretchable band (4*a*) extends all around the front and back to form a flexible under band that is detached from the garment and provides support and comfort to the wearer's breasts.

The upper ends of the left and right fabric members (2*b*) are not attached at the middle portion of the chest. The respective lower ends of (2*b*) are joined only for a short length (17) to form at the center, a joined central portion (2*b*'+2*b*'), in the center of the frontal chest view. Since the upper ends of the fabric members 2*a* and 2*b* are joined, they create a vertical orientation and the upper edges of the triangular cups are diagonally oriented to form a sweetheart neckline or a deep neckline (16). The sweetheart neckline or the deep neckline (16) is located at a lower level than the garment neckline (15). The joined portion (2*b*'+2*b*') is attached to the stretchable band (4*a*) in the region of the waist.

In FIG. 4, in the frontal view, a band (18) one to three inches in width, is stitched into the stretchable band (4*a*) such that band (18) lies below the upper member (6) of the garment (100). Band (18) provides additional support to the breasts, and is attached to the side seams of the garment (100) in the region represented by 8*a*. In FIG. 1, band (18) is shown as extending all around the back.

Figure 2:
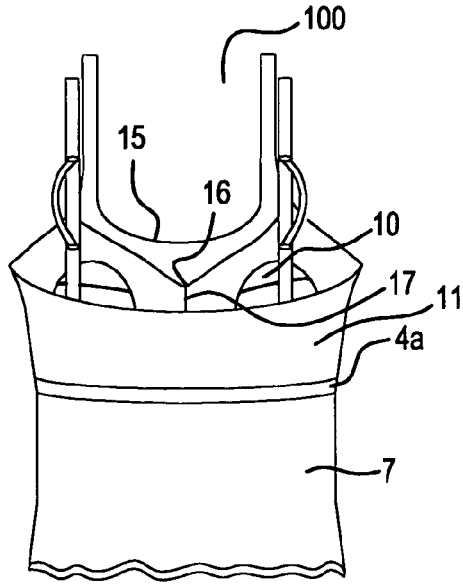
FIG. 2 is a back view of the garment piece of FIG. 1, in the shape of a camisole.

FIG. 2 shows the back view of the garment (100) in the embodiment of a camisole, having a bodice (11), the stretchable band (4*a*) and a short skirt (7).

FIGS. 5 to 8 show another embodiment of women's apparel, a nursing garment (200) in the shape of a one piece camisole (12). The maternity and/or nursing breast support in this style of the camisole, is structured as described for embodiment (100) but instead of being attached to the stretchable band (4*a*) at the waist, it comprises a flexible band portion (14) to which a plurality of lower ends of fabric members (2*a*) and (2*b*) are attached. The stretchable band (4*a*) extends all around the front and back to form a flexible under band that is detached from the garment and attached at the top portion of the garment in front and at the back. This allows the stretchable band (4*a*) to lift large and heavy milk filled breasts and provides comfort to the wearer's breasts. The unique features of providing support and comfort are ensured by using a stretchable and flexible type of material. In this embodiment, alternative locations for support may be used, for example, by attaching the narrow portions of the side of the cups to the narrow sides of the support itself, and/or to narrow portions of the sleeve portion of the garment.

There is no stretchable band (4*a*) because there is no waistline, but instead there is a flexible band (14), made of elastic and stretchable material, that extends all around the bodice below the breast line. The unique feature of this embodiment is that the maternity/nursing breast support comprises a front portion and a back portion. The front portion is similar in some aspects to the embodiment described in FIGS. 1 to 4, but the back portion (19) is in the shape of a bodice, connected to the front portion at side seams (20) on the side. At the upper portion of the back portion (19), the maternity/nursing support is attached to the upper member (6) top by seam (21). Both the front and back structures of the maternity/nursing support may be made from the same fabric as used for the upper member when the fabric is flexible and stretchable. The maternity and/or nursing breast support described in FIGS. 5–8 may also be used with the camisole described in FIGS. 1 and 2.

Figure 9:
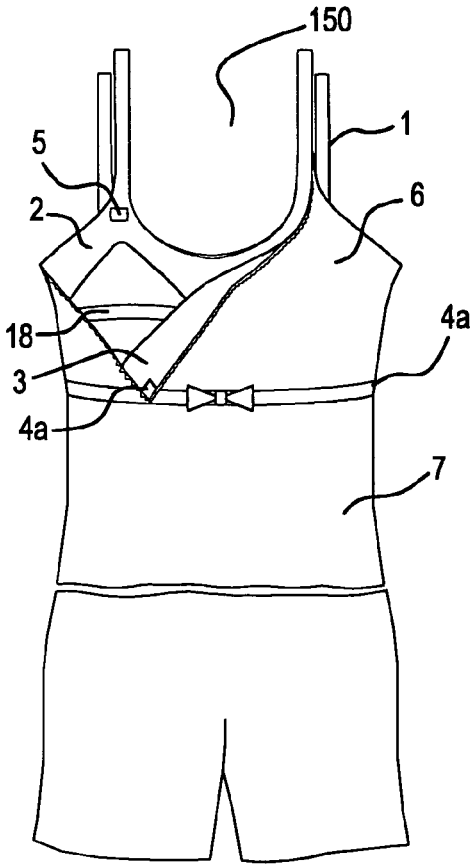
FIG. 9 shows a is a frontal view of the garment piece in the shape of a sports tankini having a bodice portion, the garment piece has attached to it a maternity and/or nursing breast support and a bra cup open.
Figure 10:
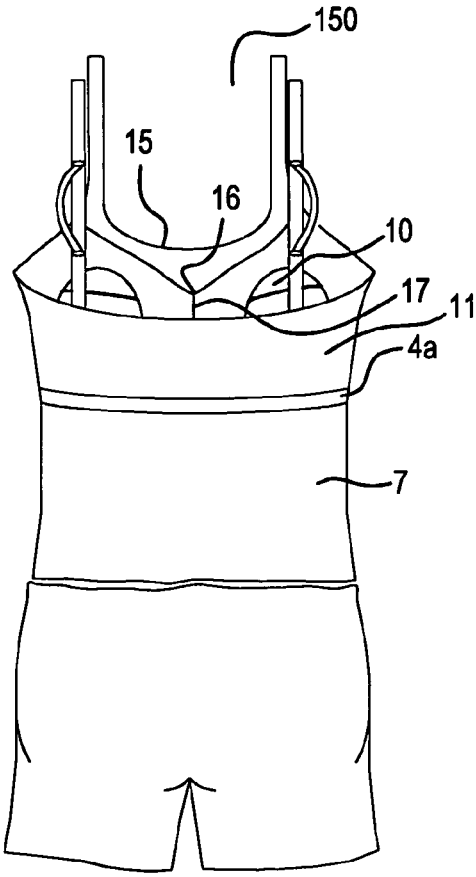
FIG. 10 is a back view of the garment piece of FIG. 9, in the shape of a sports tankini.
Figure 11:
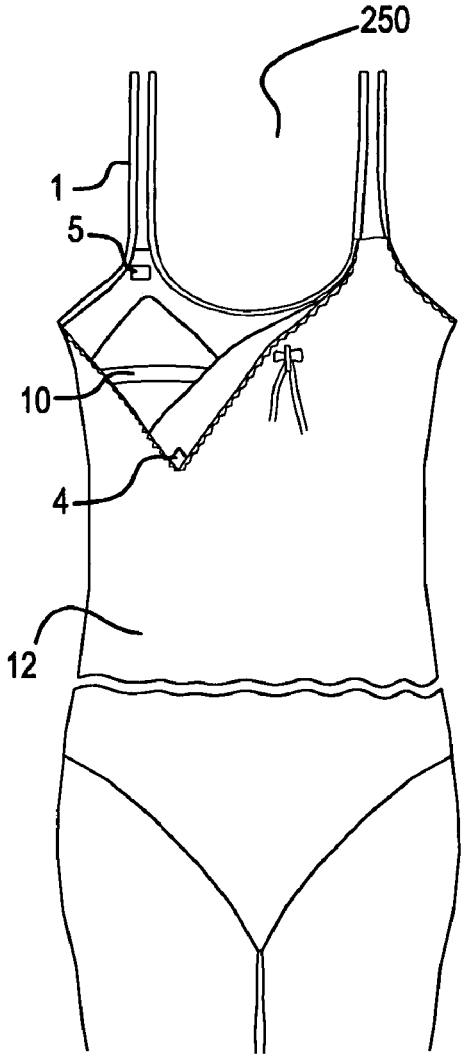
FIG. 11 is a frontal view of the tankini swimwear having attached to it a maternity and/or nursing breast support.
Figure 12:
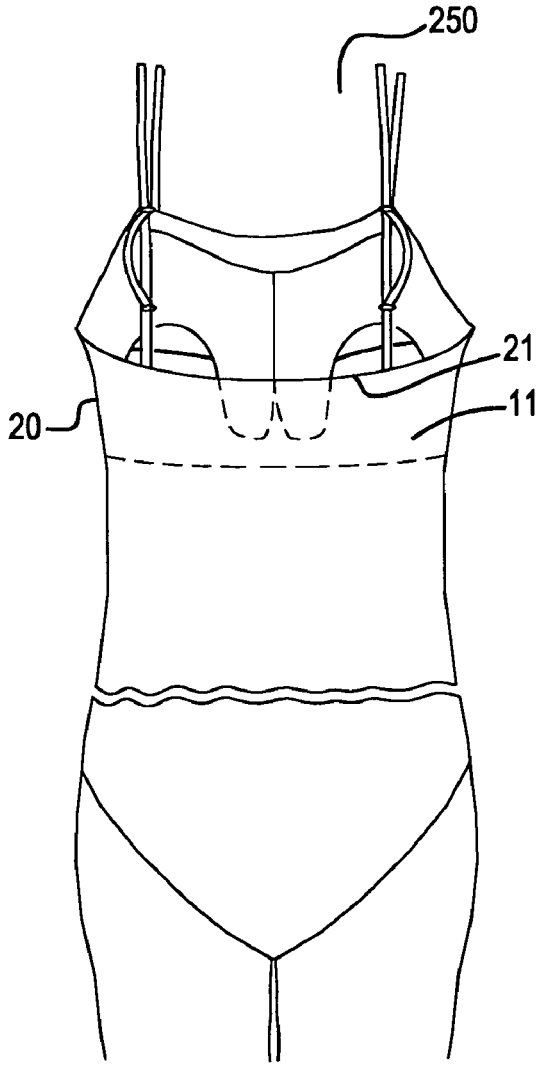
FIG. 12 is a back view of the tankini swimwear of FIG. 11.

FIGS. 9 and 10 describe the frontal and back views on an additional embodiment (150) called the sport tankini that is used as a top for sportswear. The attachment of the maternity/nursing support is similar to that shown in FIGS. 3 and 4. FIGS. 11 and 12 describe the frontal and back views on an additional embodiment (250) called the tankini that is used as a top for swimwear. The attachment of the maternity/nursing support is similar to that shown in FIGS. 7 and 8. Additionally, numerous stylistic modifications may be made to the generally vertically, horizontally or diagonally oriented portions of the maternity and/or nursing breast support embodiments within the scope of the present invention.

Figure 13:
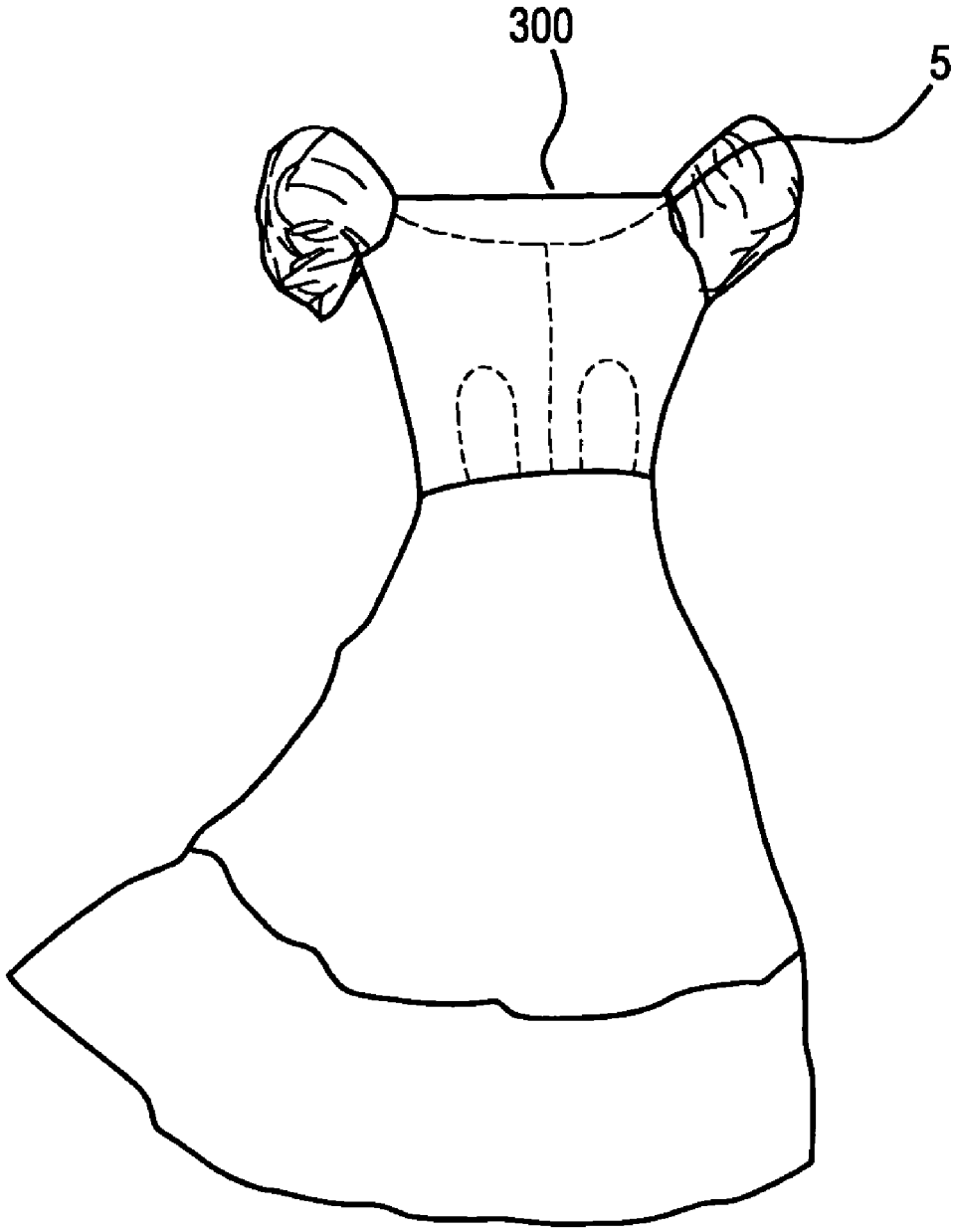
FIG. 13 is a frontal view of a dress with cap sleeves having the maternity and/or nursing breast support.
Figure 14:
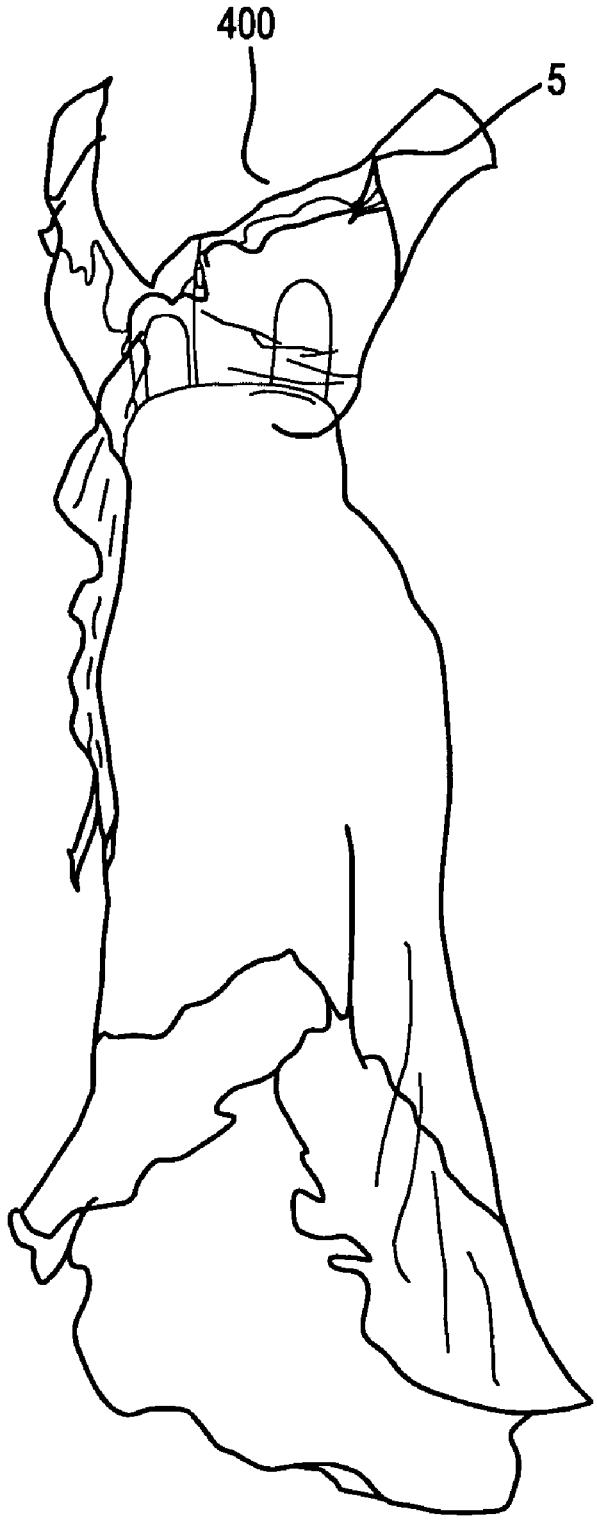
FIG. 14 is a frontal view of a gown having the maternity and/or nursing breast support.

FIGS. 13 and 14 describe yet two additional embodiments (300) and (400) for women's dresses having the maternity and/or nursing breast supports installed into the dresses.

The present invention is not to be limited in scope by the embodiment disclosed in the examples which are intended as an illustration of one aspect of the invention and any methods which are functionally equivalent are within the scope of the invention. Indeed, various modifications of the invention in addition to those shown and described herein will become apparent to those skilled in the art from the foregoing description. Such modifications are intended to fall within the scope of the appended claims.

Those skilled in the art will recognize, or be able to ascertain using no more than routine experimentation, any equivalents to the specific embodiments of the invention described herein. Such equivalents are intended to be encompassed by the claims.

What is claimed is:

1. A breast support apparel comprising:

a pair of triangular shaped bra cups;

each bra cup having a shoulder portion at the upper end of said cup, each of said shoulder portions being the point of attachment to an upper member of a garment selected from a group consisting of a camisole and a tankini;

each of said triangular shaped cups having an opening to provide support and access to the breasts, and each of said triangular shaped cups having a lower portion partially attached to a stretchable band and a side portion attached to the side of the garment.

2. The breast support apparel as recited in claim 1, wherein each of said triangular shaped cups has an upper edge, which is diagonally oriented to form a contoured neckline with the upper edge.

3. The breast support apparel as recited in claim 2, wherein the left and right triangular shaped bra cups are joined at the respective lower ends to form a joined portion at the center of the chest.

4. The breast support apparel as recited in claim 3, wherein the joined portion at the center of the chest is attached to a stretchable band.

5. The breast support apparel as recited in claim 4, wherein the stretchable band is made of a different or same fabric as the garment.

6. The breast support apparel as recited in claim 4, wherein a left and a right shoulder strap is attached to the respective left and right shoulder portion of the garment, and the garment has a left and right flap attached to a point above the breast line, each flap having a member of a fastening means to fit a corresponding member of a fastening means located at each shoulder strap.

7. The breast support apparel as recited in claim 6, wherein the member of the fastening means is selected from the group consisting of snap closure, buttons, hooks, loops, hook and loop, hook and eye, hook and loop fastener strips, ribbon ties and adhesive tape fasteners.

8. A breast support apparel comprising:

a pair of triangular bra cups, each bra cup having a shoulder strap at the upper end, each of said shoulder straps being the point of attachment to an upper member of a garment selected from the group consisting of a camisole and a tankini, each of said triangular shaped cups having an opening to provide support and access to the breasts, and each of said triangular shaped cups having a lower portion partially attached to a stretchable band extending all around the waist, and a side portion attached to the side portion of the back bodice of the breast support apparel.

9. The breast support apparel as recited in claim 8, wherein each of said triangular shaped cups has an upper edge, which is diagonally oriented to form a contoured neckline.

10. The breast support apparel as recited in claim 9, wherein the left and right triangular shaped bra cups are joined at the respective lower ends to form a joined portion at the center of the chest.

11. The breast support apparel as recited in claim 10, wherein the joined portion at the center of the chest is attached to a stretchable band.

12. The breast support apparel as recited in claim 11, wherein the stretchable band is made of a fabric selected from a group consisting of fabrics different from the garment and fabrics similar to the garment.

13. The breast support apparel as recited in claim 11, wherein a left and a right shoulder strap is attached to the left and right shoulder portion of the garment, and the garment has a left and right flap attached to a point above the breast line, each flap having a member of a fastening means to fit a corresponding member of a fastening means located at each shoulder strap.

14. The breast support apparel as recited in claim 13, wherein the member of the fastening means is selected from the group consisting of snap closure, buttons, hooks, loops, hook and loop, hook and eye, hook and loop fastener strips, ribbon ties and adhesive tape fasteners.

15. A breast support apparel comprising:

a pair of triangular shaped bra cups;

each bra cup having a shoulder portion at the upper end of said cup, each of said shoulder portions being the point of attachment to an upper member of a garment selected from a variety of dress styles, each of said triangular shaped cups having an opening to provide support and access to the breasts, and each of said triangular shaped cups having a lower portion partially attached to a stretchable band and a side portion attached to the side of the garment.

* * * * *